US008413703B2

(12) United States Patent
Yu Chen

(10) Patent No.: US 8,413,703 B2
(45) Date of Patent: Apr. 9, 2013

(54) TAPE APPLICATOR

(76) Inventor: Hsiu-Man Yu Chen, Tan Tzu Township, Taichung County (TW)

( * ) Notice: Subject to any disclaimer, the term of this patent is extended or adjusted under 35 U.S.C. 154(b) by 281 days.

(21) Appl. No.: 12/962,294

(22) Filed: Dec. 7, 2010

(65) Prior Publication Data

US 2012/0138234 A1 Jun. 7, 2012

(51) Int. Cl.
*B65H 35/07* (2006.01)
*B32B 37/10* (2006.01)

(52) U.S. Cl.
USPC ..... 156/527; 156/577; 156/579

(58) Field of Classification Search ..... 156/523, 156/527, 574, 577, 579
See application file for complete search history.

(56) References Cited

U.S. PATENT DOCUMENTS

| | | | | |
|---|---|---|---|---|
| 5,164,038 | A * | 11/1992 | Sundqvist | 156/577 |
| 5,549,255 | A * | 8/1996 | Huang | 242/422.5 |
| 5,725,726 | A * | 3/1998 | Yu | 156/577 |
| 6,257,298 | B1 * | 7/2001 | Huang | 156/577 |
| 2003/0094243 | A1 * | 5/2003 | Charriere et al. | 156/577 |

* cited by examiner

*Primary Examiner* — Mark A Osele
(74) *Attorney, Agent, or Firm* — Ming Chow; Sinorica, LLC

(57) ABSTRACT

A tape applicator has a handle, a pair of upright plates on the handle, and an accommodation space formed between the pair of upright plates. The handle is coaxially provided with a press member and an operation member. The operation member has a protruding holding plate. The holding plate holds the press member. The user can operate the operation member to turn the press member simultaneously. When the operation member is turned to its extremity, the user can further pull the press rod for the press rod to be further away from the accommodation space. Thus, the distance from the press member to the accommodation space is increased to enhance the use range of the tape applicator for different sizes of tapes.

4 Claims, 6 Drawing Sheets

TAPE APPLICATOR

BACKGROUND OF THE INVENTION

1. Field of the Invention

The present invention relates to a tape applicator which is adapted for different sizes of tapes.

2. Description of the Prior Art

FIG. 1 is a perspective view of a conventional tape applicator. FIG. 2 is a schematic view of the conventional tape applicator when in use. The conventional tape applicator comprises a main body 10, a tape cutting unit 20, and a tape fixing unit 30. The main body 10 comprises a handle 11 and a retaining bracket 12 disposed on the handle 11. The retaining bracket 12 has a pair of opposing upright plates 121 and an accommodation space 13 formed between the pair of upright plates 121. The tape cutting unit 20 is disposed between the pair of upright plates 121, and comprises a roller 21, a blade 22 and a plastering plate 23. The tape fixing unit 30 is disposed close to the pair of upright plates 121. The tape fixing unit 30 comprises a press rod 31 and a torque spring 32. The press rod 31 is transversely provided with a pivot rod 311 at a central portion thereof. The pivot rod 311 is pivotally connected to the pair of upright plates 121. Two ends of the press rod 31 are bent to form a press rod 312 and an operation lever 313 which are parallel to the pivot rod 311, so the press rod 30 is in an E shape. A torque spring 32 is fitted on the pivot rod 311. Two ends of the torque spring 32 are against the retaining bracket 12 and the press rod 312, respectively, such that the press rod 312 is elastically against the outer edges of the pair of upright plates 121. As shown in FIG. 2, when a roll of tape 40 is secured to the tape applicator, the user can press the operation lever 313 to turn the press rod 312, so that the press rod 312 is away from the accommodation space 13. After that, the central paper axle 41 of the roll of tape 40 is fitted on the press rod 312. When the user releases the operation lever 313, the torque spring 32 will provide an elastic force to secure the roll of tape 40 to the tape applicator.

However, people have environmental consciousness gradually, so the roll of tape 40 is improved. Referring to FIG. 2, the improved roll of tape 40' has a larger diameter than that of the conventional roll of tape 40, and the diameter of the central paper axle 41' of the improved roll of tape 40' is greatly reduced for getting more tape on the paper axle 41'. But, this results in that the distance from the outer diameter to the inner diameter of the roll of tape 40' has doubled, so the improved roll of tape 40' can not be used on the existing tape applicators. As shown in FIG. 2, when the user presses down the operation lever 313 to the extremity, the distance from the press rod 312 to the accommodation space 13 is smaller than the distance from the outer diameter to the inner diameter of the improved roll of tape 40'. The improved roll of tape 40' can not be fitted on the press rod 312. Accordingly, the inventor of the present invention has devoted himself based on his many years of practical experiences to provide a tape applicator for the improved roll of tape 40'.

SUMMARY OF THE INVENTION

The primary object of the present invention is to provide a tape applicator, which can be widely used for different sizes of tapes.

The present invention is to provide a tape applicator which comprises a main body. The main body comprises a handle and a retaining bracket disposed on the handle. The retaining bracket has a pair of opposing upright plates and an accommodation space formed between the pair of upright plates.

The tape applicator further comprises a tape cutting unit. The tape cutting unit comprises a roller, a blade and a plastering plate. The roller is pivotally connected between the pair of upright plates. The blade is fixed between the pair of upright plates and located above the roller. The plastering plate is fixed between the pair of upright plates and located above the blade. The tape applicator further comprises a tape fixing unit. The tape fixing unit comprises a press member, a torque spring and an operation member. The press member has a carrying rod. Two ends of the carrying rod are bent in the same direction to form a pivot rod and a press rod. The pivot rod is pivotally connected to the pair of upright plates. The torque spring is fitted on the pivot rod. Two ends of the torque spring are against the retaining bracket and the press rod, respectively. The press rod is elastically against outer edges of the pair of upright plates. The operation member has a driving rod. Two ends of the driving rod are respectively provided with a limit portion and a transverse operation lever. The limit portion and the pivot rod of the press member are coaxially pivoted to the pair of upright plates. The operation member further has a holding plate protruding from the limit portion. The holding plate holds the carrying rod of the press member.

The tape applicator of the present invention is adapted for different sizes of tapes. When the user presses down the operation lever of the operation member, the holding plate will bring the carrying rod to link the press rod to be away from the accommodation space. When the operation lever is pressed to its extremity, the user can further pull the press rod so that the press rod is further away from the accommodation space. Thus, the user can put the roll of tape on the press rod with ease, providing a larger spacer for the roll of tape to be installed to the tape applicator.

DETAILED DESCRIPTION OF THE PREFERRED EMBODIMENTS

Embodiments of the present invention will now be described, by way of example only, with reference to the accompanying drawings.

Figure 1:
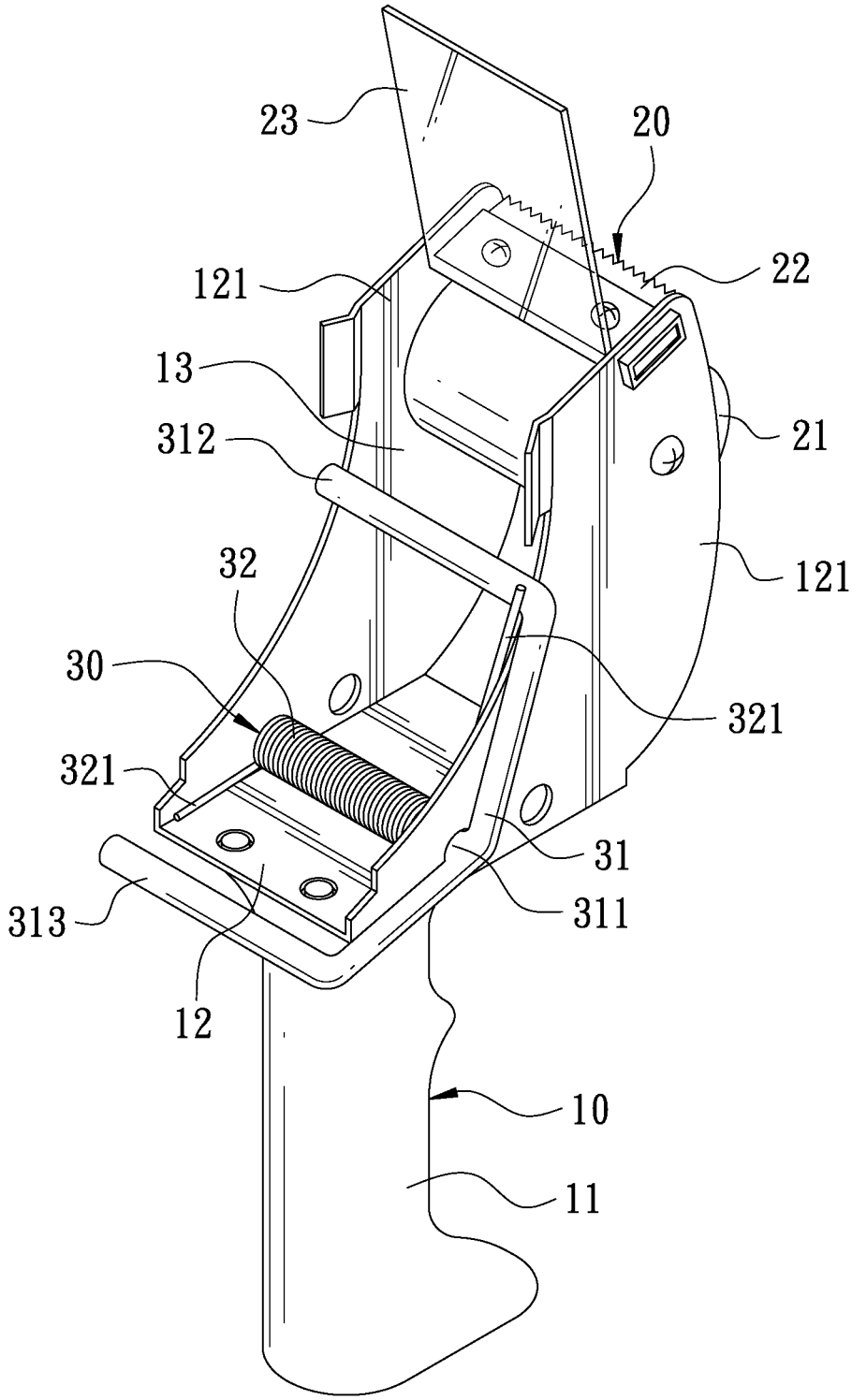
FIG. 1 PRIOR ART
FIG. 1 is a perspective view of a conventional tape applicator.
Figure 2:
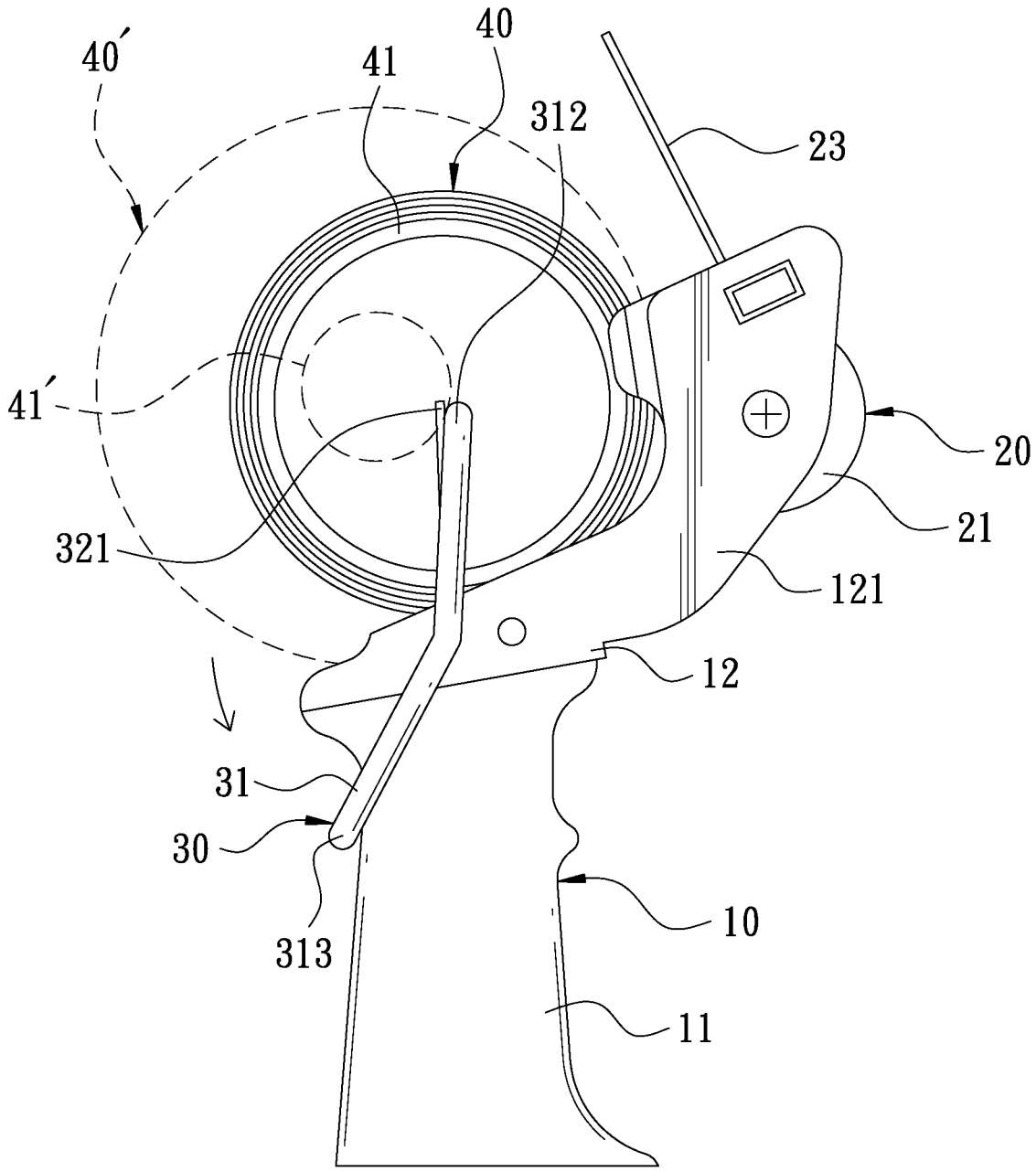
FIG. 2 PRIOR ART
FIG. 2 is a schematic view of the conventional tape applicator when in use.
Figure 3:
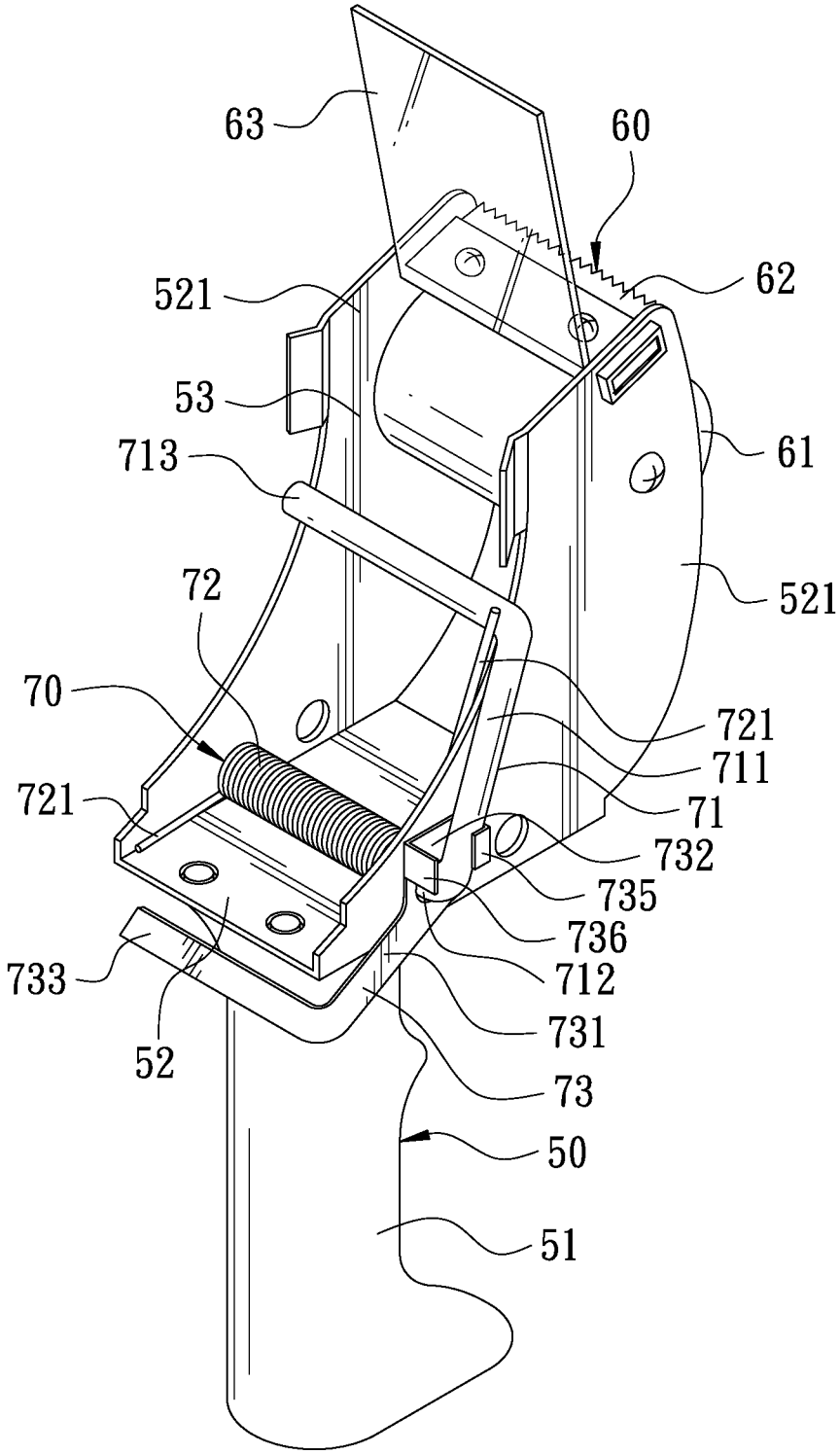
FIG. 3 is a perspective view according to a preferred embodiment of the present invention.
Figure 4:
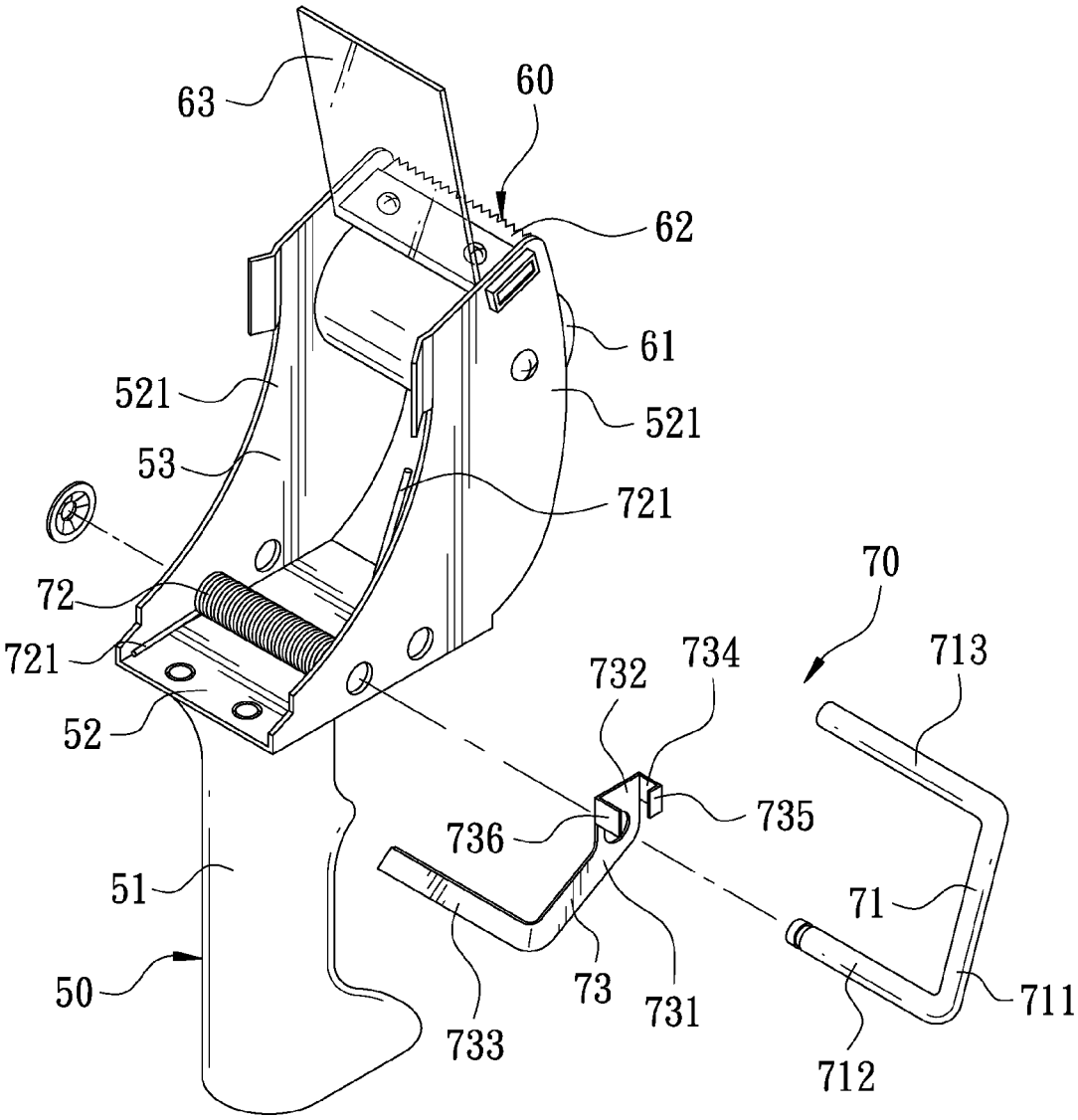
FIG. 4 is an exploded view according to the preferred embodiment of the present invention.

As shown in FIG. 3 and FIG. 4, a tape applicator for different sizes of tapes according to a preferred embodiment of the present invention comprises a main body 50, a tape cutting unit 60, and a tape fixing unit 70.

The main body 50 comprises a handle 51 and a retaining bracket 52 disposed on the handle 51. The retaining bracket 52 has a pair of opposing upright plates 521 and an accommodation space 53 formed between the pair of upright plates 521 to accommodate a roll of tape 80.

The tape cutting unit 60 comprises a roller 61, a blade 62 and a plastering plate 63. The roller 61 is pivotally connected between the pair of upright plates 521. The blade 62 is fixed between the pair of upright plates 521 and located above the roller 61. The plastering plate 63 is fixed between the pair of upright plates 521 and located above the blade 62.

The tape fixing unit 70 comprises a press member 71, a torque spring 72, and an operation member 73.

The press member 71 has a carrying rod 711. Two ends of the carrying rod 711 are bent in the same direction to form a pivot rod 712 and a press rod 713. The pivot rod 712 is pivotally connected to the pair of upright plates 521.

The torque spring 72 is fitted on the pivot rod 712. Two ends 721 of the torque spring 72 are against the retaining bracket 52 and the press rod 713, respectively, so that the press rod 713 is elastically against outer edges of the pair of upright plates 521.

The operation member 73 has a driving rod 731. Two ends of the driving rod 731 are respectively provided with a limit portion 732 and a transverse operation lever 733. The limit portion 732 and the pivot rod 712 of the press member 71 are coaxially pivoted to the pair of upright plates 521. The operation member 73 further has a holding plate 734 protruding from the limit portion 732. The holding plate 734 and the carrying rod 711 of the press member 71 are disposed in the same direction to hold one side of the carrying rod 711. The holding plate 734 of the operation member 73 has a free end which is transversely provided with a stop plate 735. The operation member 73 further has a limit plate 736 protruding from the limit portion 732. The limit plate 736 is opposite to the holding plate 734 to hold another side of the carrying rod 711.

Figure 5:
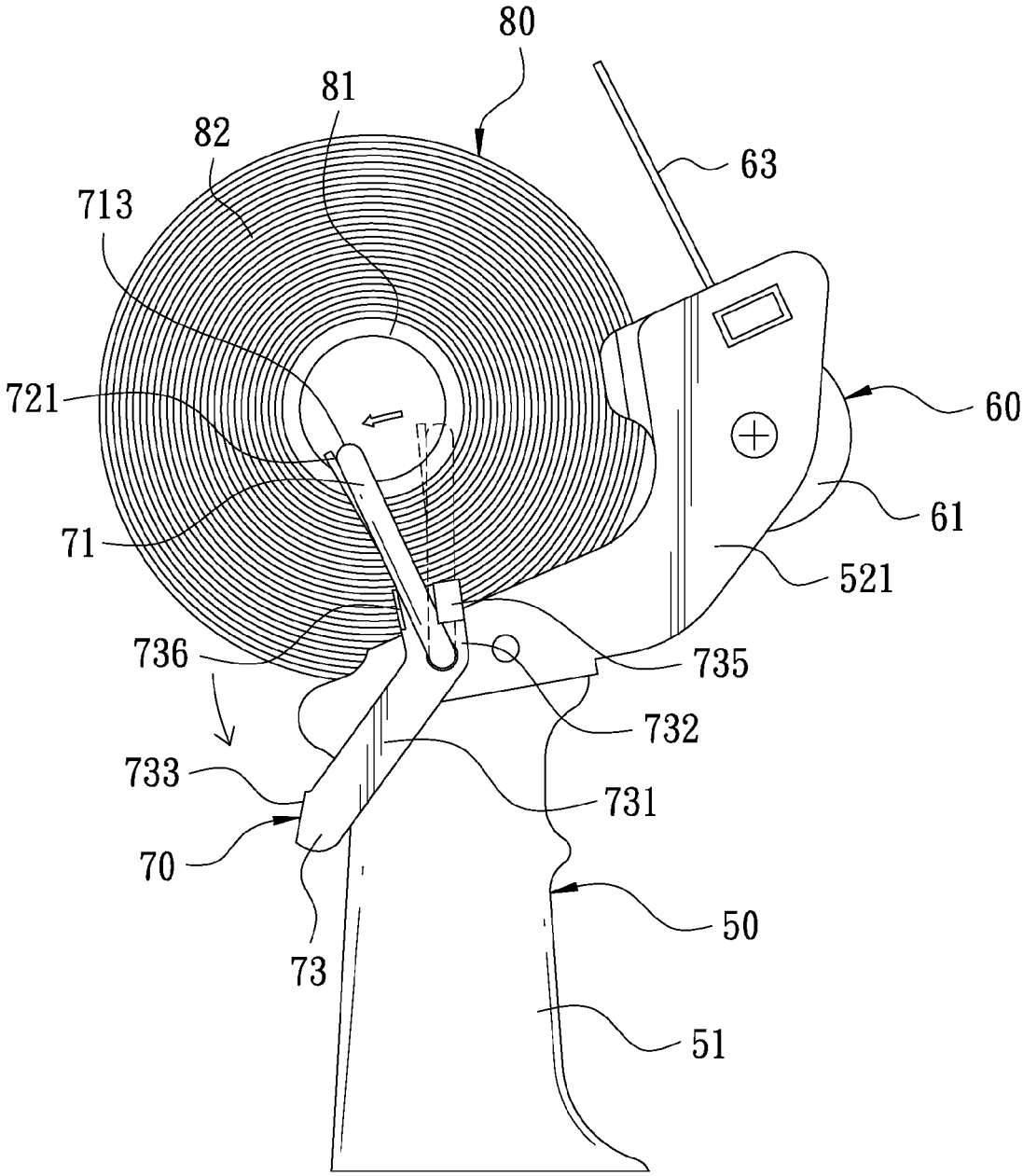
FIG. 5 is a schematic view of the preferred embodiment of the present invention when in use to show that the roll of tape has not yet been fixed to the tape applicator.
Figure 6:
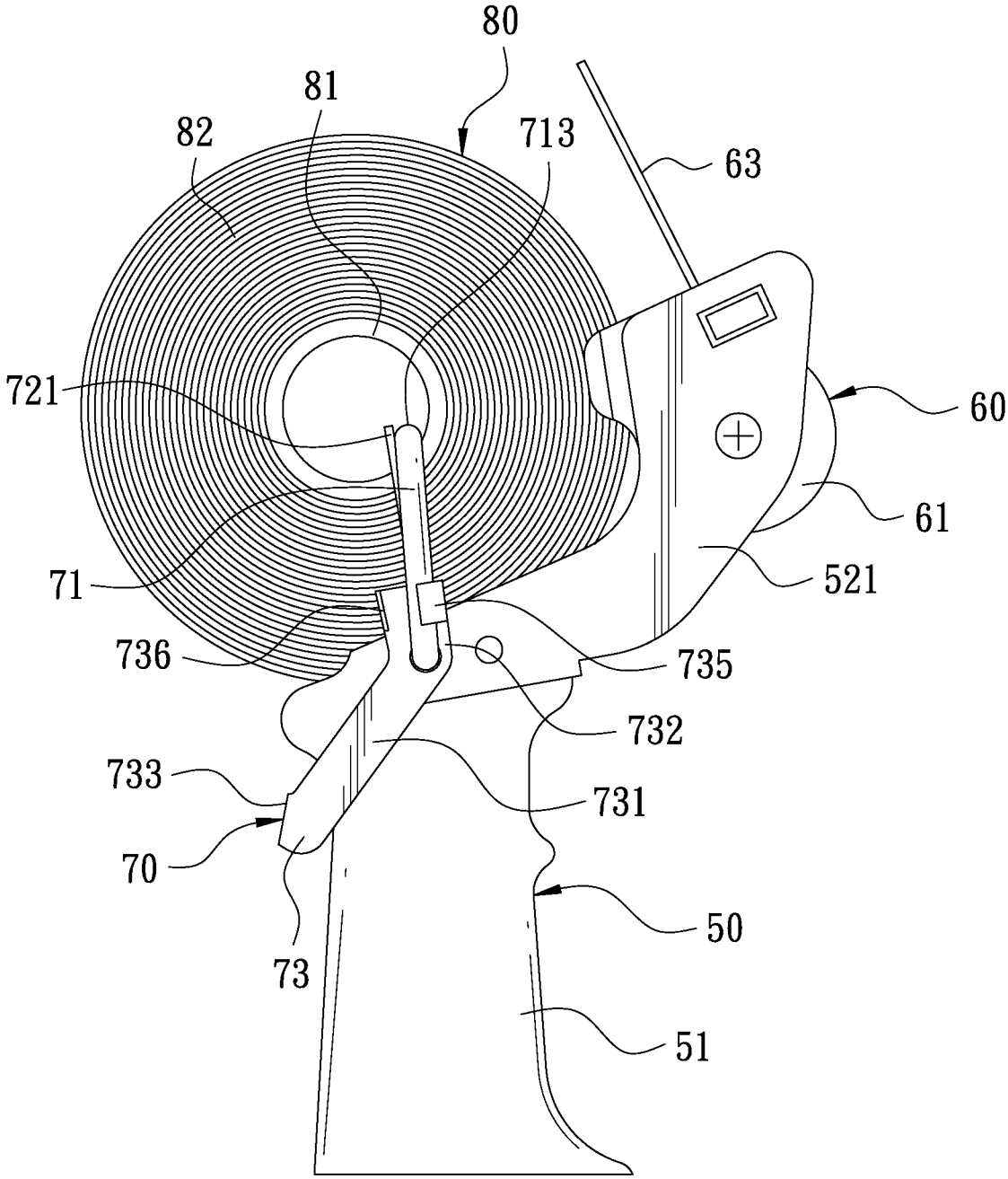
FIG. 6 is a schematic view of the preferred embodiment of the present invention when in use to show that the roll of tape is fixed to the tape applicator.

Referring to FIG. 5 and FIG. 6, when the user wants to fix the roll of tape 80 to the tape applicator, the user just presses down the operation lever 733 of the operation member 73. The holding plate 734 will bring the carrying rod 711 to link the press rod 713 to be away from the accommodation space 53. As shown in FIG. 5, the distance from the outer diameter to the inner diameter of the roll of the tape 80 is larger than the distance from the press rod 713 to the accommodation space 53. The user can further pull the press rod 713, so that the press rod 713 is further away from the accommodation space 53 until the press rod 713 leans against the limit plate 736 so as to increase the distance from the press rod 713 to the accommodation space 53. Thus, the user can put the roll of tape 80 on the press rod 713 with ease, providing a larger space for the roll of tape to be installed to the tape applicator. After that, the user releases the operation lever 733, and the torque spring 72 will provide a restoring elasticity to the press lever 713 so that the press lever 713 has a pre-stress to move toward the accommodation space 53. As shown in FIG. 6, the roll of tape 80 is secured in the accommodation space 53 for the user to pull out the tape 82 of the roll of the tape 80. The tape cutting unit 60 is adapted for cutting of the roll of the tape 80.

It is noted that the holding plate 734 and the carrying rod 711 are disposed in the same direction to enhance the stress area, so that the operation member 73 can easily bring the carrying rod 711 to activate. Besides, the limit plate 376 of the operation member 73 is used to limit the turning angle of the carrying rod 711, preventing the torque spring 72 from being damaged because of over turning by the user. The stop plate 735 is used to confine the carrying rod 711 to be located between the holding plate 734 and the limit plate 736, preventing the carrying rod 711 from disengagement.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A tape applicator, comprising:

a main body comprising a handle and a retaining bracket disposed on the handle, the retaining bracket having a pair of opposing plates and an accommodation space formed between the pair of plates;

a tape cutting unit comprising a roller, a blade and a plastering plate, the roller being pivotally connected between the pair of plates, the blade being fixed between the pair of plates and located next to the roller, the plastering plate being fixed between the pair of plates and located next to the blade; and a tape fixing unit comprising a press member, a torque spring and an operation member;

the press member having a carrying rod, two ends of the carrying rod being bent in the same direction to form a pivot rod and a press rod, the pivot rod being pivotally connected to the pair of plates;

the torque spring being fitted on the pivot rod, two ends of the torque spring being against the retaining bracket and the press rod respectively, the press rod being elastically against outer edges of the pair of plates;

the operation member having a driving rod, two ends of the driving rod being respectively provided with a limit portion and a transverse operation lever, the limit portion and the pivot rod of the press member being coaxially pivoted to the pair of plates, the operation member further having a holding plate protruding from the limit portion, the holding plate holding one side of the carrying rod of the press member.

2. The tape applicator as claimed in claim 1, wherein the holding plate and the carrying rod of the press member are disposed in the same direction.

3. The tape applicator as claimed in claim 1, wherein the operation member further has a limit plate protruding from the limit portion, and the limit plate is opposite to the holding plate to hold the other side of the carrying rod.

4. The tape applicator as claimed in claim 1, wherein the holding plate of the operation member has a free end which is transversely provided with a stop plate.

* * * * *